US008779933B2

(12) United States Patent
Hartmann et al.

(10) Patent No.: US 8,779,933 B2
(45) Date of Patent: Jul. 15, 2014

(54) STATUS DETECTOR AND COMMUNICATION UNIT AND SYSTEM FOR REMOTE TRACKING OF PADLOCKS

(75) Inventors: Avi Hartmann, Binyamina (IL); Uri Hartmann, Tel Aviv (IL); Doron Kedem, Tel Aviv (IL)

(73) Assignee: Mul-T-Lock Technologies Ltd., Yavne (IL)

( * ) Notice: Subject to any disclaimer, the term of this patent is extended or adjusted under 35 U.S.C. 154(b) by 145 days.

(21) Appl. No.: 13/521,013

(22) PCT Filed: May 1, 2011

(86) PCT No.: PCT/IL2011/000349

§ 371 (c)(1),
(2), (4) Date: Jul. 6, 2012

(87) PCT Pub. No.: WO2012/042515

PCT Pub. Date: Apr. 5, 2012

(65) Prior Publication Data

US 2013/0036781 A1 Feb. 14, 2013

Related U.S. Application Data

(60) Provisional application No. 61/404,105, filed on Sep. 28, 2010.

(51) Int. Cl.

| | |
|---|---|
| ***G08B 21/00*** | (2006.01) |
| ***E05B 45/06*** | (2006.01) |
| ***E05B 45/08*** | (2006.01) |

(52) U.S. Cl.

CPC ..... *E05B 45/06* (2013.01); *E05B 45/08* (2013.01); *E05B 45/083* (2013.01)

USPC ..... 340/686.1; 70/38 A

(58) Field of Classification Search

CPC ..... E05B 45/06; E05B 45/08; E05B 45/083; E05B 37/0034; E05B 37/025; E05B 67/38

USPC ..... 340/686.1, 542; 70/21, 25, 26, 38 A, 51, 70/432–434

See application file for complete search history.

(56) References Cited

U.S. PATENT DOCUMENTS

| | | | |
|---|---|---|---|
| 4,556,872 | A | 12/1985 | Masoncup et al. |
| 5,046,084 | A | 9/1991 | Barrett et al. |
| 5,587,702 | A | 12/1996 | Chadfield |

(Continued)

FOREIGN PATENT DOCUMENTS

| | | | |
|---|---|---|---|
| FR | 2 904 135 | A1 | 1/2008 |
| WO | WO 03/002837 | A1 | 1/2003 |

*Primary Examiner* — John A Tweel, Jr.
(74) *Attorney, Agent, or Firm* — Seed IP Law Group PLLC

(57) ABSTRACT

A status detector and communication unit (20) for a padlock (10) having a body (11) and a shackle (12) at least one end (14) of which can be latched to and released from the body. The status detector and communication unit includes a casing (21) adapted to be securely retrofitted to the padlock so as to form a compact assembly without obscuring an operating mechanism (17) of the padlock, and a battery powered circuit (22) contained within the casing for co-operating with the shackle of the padlock for transmitting a signal indicative of a status of the shackle to a remote monitoring unit (93). The invention allows remote monitoring of a conventional padlock with little or no modification of the padlock.

19 Claims, 8 Drawing Sheets

(56) References Cited

U.S. PATENT DOCUMENTS

| | | | | |
|---|---|---|---|---|
| 5,831,531 | A | 11/1998 | Tuttle | |
| 6,046,558 | A | 4/2000 | Larson et al. | |
| 6,047,575 | A | 4/2000 | Larson et al. | |
| 6,442,983 | B1 * | 9/2002 | Thomas et al. | 70/38 A |
| 7,010,944 | B1 * | 3/2006 | Chiu | 70/26 |
| 7,216,517 | B2 * | 5/2007 | Ling et al. | 70/21 |
| 7,236,085 | B1 * | 6/2007 | Aronson et al. | 70/63 |
| 7,325,425 | B1 | 2/2008 | Miller | |
| 7,458,240 | B1 * | 12/2008 | Miao | 70/21 |
| 7,472,568 | B2 * | 1/2009 | Tang | 70/39 |
| 8,171,760 | B2 * | 5/2012 | Yen et al. | 70/25 |
| 2006/0107709 | A1 * | 5/2006 | Yu | 70/21 |
| 2008/0036596 | A1 | 2/2008 | Auerbach et al. | |

* cited by examiner

STATUS DETECTOR AND COMMUNICATION UNIT AND SYSTEM FOR REMOTE TRACKING OF PADLOCKS

CROSS-REFERENCE TO RELATED APPLICATIONS

This application is a U.S. national stage application filed under 35 U.S.C. §371 of International Patent Application PCT/IL2011/000349, accorded an international filing date of May 1, 2011, which claims the benefit of U.S. Provisional Patent Application No. 61/404,105 filed Sep. 28, 2010, which applications are incorporated herein by reference in their entirety.

BACKGROUND

1. Technical Field

This disclosure relates to remote tracking of locks, particularly so as to allow a change in status of the lock to be detected, monitored remotely.

2. Description of the Related Art

Electronic and electromechanical padlocks that allow remote control and data logging are known in the art.

U.S. Pat. No. 6,047,575 discloses an electronic padlock having a body and shackle and a motor-operated latch assembly within the body and operable by a motor for latching and releasing the end of the shackle. An encoder is coupled to the latch assembly for moving into respective positions depending on when the end of the shackle is latched or released. A circuit within the body detects the position of the encoder and generates a signal relating to the encoder position, thus indicating whether the shackle is latched or released.

US 2008/0036596 discloses a key-operated remotely monitorable locking assembly including a key-operated lock including a body including a key operated locking assembly and a tamper monitorable lockable assembly which is selectably locked to the body by operation of the mechanical key operated locking assembly and a wireless communication circuit located in at least one of the lock body and the lockable assembly for providing a remotely monitorable indication of tampering with the lockable assembly. The arrangement shown in US 2008/0036596 relates particularly to a padlock having a flexible shackle, which is modified by providing a longitudinal bore through which a wire is passed. Opposite ends of the wire are connected to switch contacts mounted on a PCB within the padlock so as to provide an alert signal if the shackle is cut.

U.S. Pat. Nos. 4,556,872 and 5,587,702 disclose padlocks housing a tamper alarm and integral battery.

U.S. Pat. No. 5,831,531 discloses a secure lock for a shipping container in which an electrically conductive cable is anchored between the doors of the container and whose continuity is monitored by an RFID.

U.S. Pat. No. 5,046,084 discloses an electronic lock-box system configured to transmit data by fax from a central computer to a real estate office so as to allow a real estate agent to monitor access to keys of houses listed for sale.

U.S. Pat. No. 6,046,558 discloses an electronic padlock having a body and shackle and a motor-operated latch assembly for latching and releasing the end of the shackle. Security problems related to a failure of the latch mechanism are monitored using an optical encoder that provides position information to a control circuit, which correlates the position information with a signal directing power to the motor for controlling the motor remotely.

It emerges from the foregoing discussion that padlocks having integral encoders for monitoring the latching mechanism are known as is the use of such padlocks in shipping containers. However, known such padlocks are motor-operated, which gives rise to a number of potential problems such as described in U.S. Pat. No. 6,046,558. Moreover, the encoders are integrated within the padlock during manufacture, which is not only expensive but means that a regular padlock is not easily amenable to being monitored using the approaches described in the prior art.

BRIEF SUMMARY

One or more embodiments of the present disclosure provide a padlock and remote monitoring system that addresses these drawbacks.

According to a first embodiment of the disclosure there is provided a status detector and communication unit for a padlock having a body and a shackle at least one end of which can be latched to and released from the body, the status detector comprising:

a casing adapted to be securely retrofitted to the padlock so as to form a compact assembly without obscuring an operating mechanism of the padlock, and a battery powered circuit contained within the casing for co-operating with the shackle of the padlock for transmitting a signal indicative of a status of the shackle to a remote monitoring unit.

BRIEF DESCRIPTION OF THE SEVERAL VIEWS OF THE DRAWINGS

In order to understand the disclosure and to see how it may be carried out in practice, embodiments will now be described, by way of non-limiting example only, with reference to the accompanying drawings, in which.

DETAILED DESCRIPTION

In the following description of some embodiments, identical components that appear in more than one figure or that share similar functionality will be referenced by identical reference symbols.

Figure 1A:
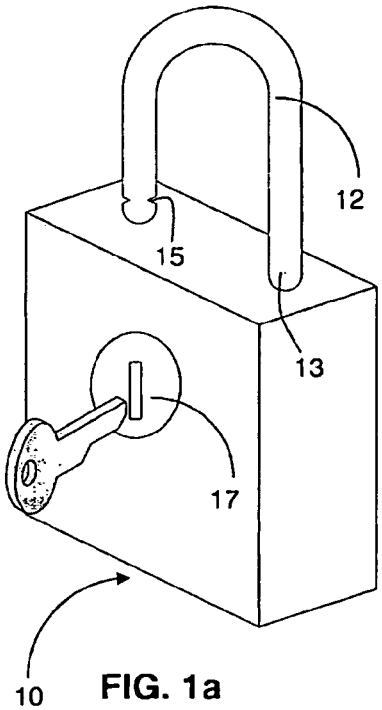
FIGS. 1*a*, 1*b* and 1*c* are pictorial representations showing details of a padlock useful in explaining the principle of operation of the disclosure.
Figure 1B:
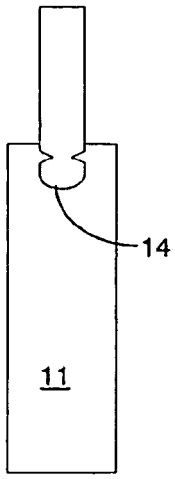
Figure 1C:
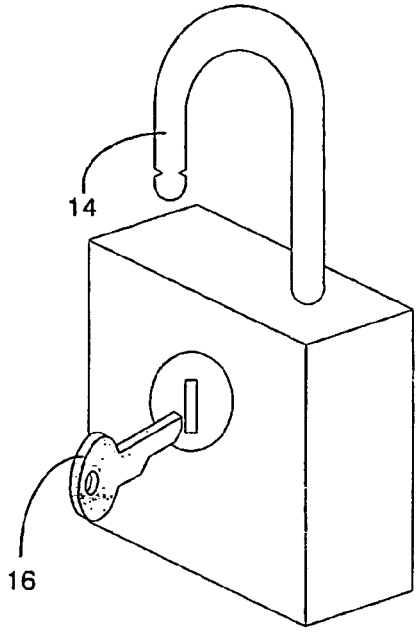

FIGS. 1*a*, 1*b* and 1*c* are pictorial representations showing details of a padlock 10 useful in explaining the principle of operation of the disclosure. The padlock has a body 11 and a shackle 12, a first end 13 of which is rotatably fixed within a cavity in the body and a second end 14 of which has a circumferential indent 15, which engages a locking member (not shown) that is released by a key 16 inserted into a keyhole 17 or by a combination lock. Padlocks are well known in the art and since one object of the disclosure is to allow the status of any padlock to be monitored remotely, further mechanical details are not necessary to understand the basic principle of the disclosure.

In the locked state depicted in FIG. 1*a*, the second end 14 of the shackle 12 is concealed within the body 11 as shown more clearly in FIG. 1*b*, while in the unlocked state it protrudes out of the body as shown in FIG. 1*c*.

The present disclosure resides principally in the secure coupling of a status detector and communication unit to a padlock so as to provide an indication of whether the padlock is open or closed and to report this to a remote monitoring unit, while being amenable for retrofitting to existing padlocks with minimal customization of the padlocks. With reference to FIGS. 3 to 5, there will be described below an embodiment that has been reduced to practice and requires only minor modification to the shackle of the padlock. FIGS. 6 and 7 show alternative embodiments requiring significant changes to the padlock, while still allowing subsequent retrofitting of the status detector and communication unit.

Figure 2:
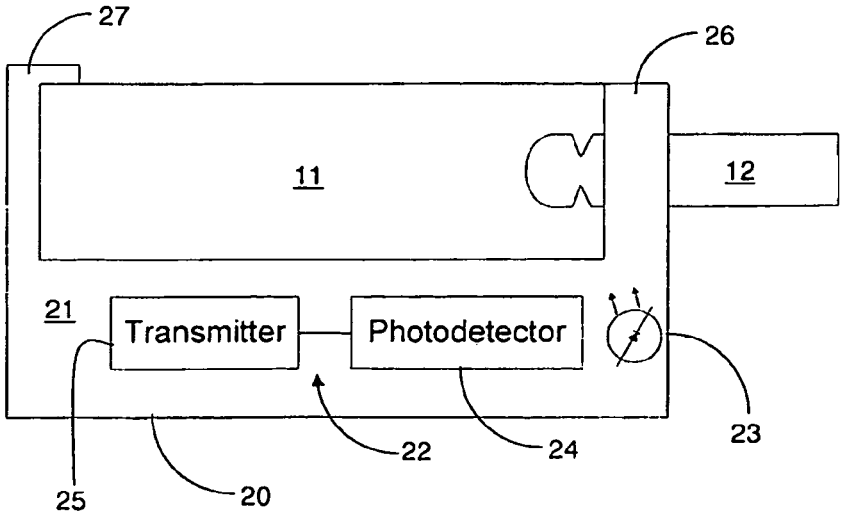
FIG. 2 shows schematically a status detector adapted to be retrofitted to the padlock.

At the other extreme, we present in FIG. 2 an arrangement where the end-user himself could conceivably modify the shackle of an off-the-shelf padlock for use with the disclosure. Thus, FIG. 2 shows schematically a status detector and communication unit 20 having a casing 21 adapted to be securely retrofitted to the padlock 10 so as to form a compact assembly without obscuring the keyhole 17. A battery powered circuit shown generally as 22 within the casing cooperates with the shackle 12 for transmitting a signal indicative of a status of the shackle to a remote monitoring unit (not shown). By way of schematic example only, in FIG. 2 the circuit 22 is shown to include a photodiode 23 (constituting a light emitter) that directs light on to the second end 14 of the shackle and a photodetector 24 that detects light reflected back by the second end 14 of the shackle, thus indicating that the second end 14 of the shackle is engaged within the body of the padlock. On the other hand, when the padlock is opened, the second end 14 of the shackle disengages from the body of the padlock and springs upward out of line of sight of the photodiode 23. Consequently, light from the photodiode 23 is no longer reflected to the photodetector 24. Thus, the photodetector 24 serves to detect the status of the shackle and a transmitter 25 coupled to the photo detector 24 conveys a status signal to the remote monitoring unit.

Such an arrangement obviates the need for the padlock to be modified and, in particular, avoids the need for an encoder to be provided within the body of the padlock as is necessary in hitherto-proposed schemes. At its simplest, the casing 21 of the status detector and communication unit 20 may be provided with a bracket 26 at its upper having an aperture through which the shackle is inserted so that, once the padlock is locked, the status detector and communication unit 20 is retained on the padlock. A resilient L-shaped bracket 27 on the lower end of the casing 21 may then be snap-fitted to the base of the padlock as shown in FIG. 2. Alternatively, a split casing may be used so that opposing sections are mounted on opposite sides of the body 11 and then snapfitted. In the padlock shown in FIG. 1, where the keyhole 17 is on a major surface of the body 11 of the padlock, the status detector and communication unit 20 is mounted on the opposite surface and if a split casing is used, that part of the casing that is mounted on the same surface of the keyhole must be dimensioned or shaped so as to ensure that the keyhole 17 remains accessible. Commonly, as shown in FIG. 3*b*, the keyhole 17 is provided on a lower surface of the body opposite the shackle and no such problem arises. In either case, the status detector and communication unit 20 is held firmly against the padlock in proper spatial disposition to the shackle, thus permitting reliable detection at all times of the shackle's status. Although the status detector and communication unit 20 in this simple embodiment can be forcibly removed from the padlock, doing so will immediately cause an open status to be detected and transmitted to the remote monitoring unit. Hence, there is in fact no incentive to tamper with the status detector and communication unit 20. However, if desired, a more permanent fixation can be achieved by joining opposing sections of a split casing, for example, using rivets or plastic welds.

If desired, instead of relying on the absence or detection of light reflected from the end of the shackle, two colored bands of different reflectivity could be painted on the periphery of the shackle: one on that part of the shackle that is normally obscured when the padlock is locked and the other on a part of the shackle that is exposed. Upon opening the padlock the intensity of the reflected light sensed by the photodetector 24 varies according to which band reflects the light. Likewise, the exposed band could be provided with different colored segments around its periphery each segment having a different reflectivity. Rotation of the shackle within the padlock without its removal would then result in different intensities being sensed by the photodetector. This is useful if the padlock is tampered with by cutting the shackle since rotation of the shackle can then be detected and reported. Better security is achieved by providing corresponding segmented bands on the two opposing ends of the shackle so that rotation of either end may be monitored.

Figure 3A:
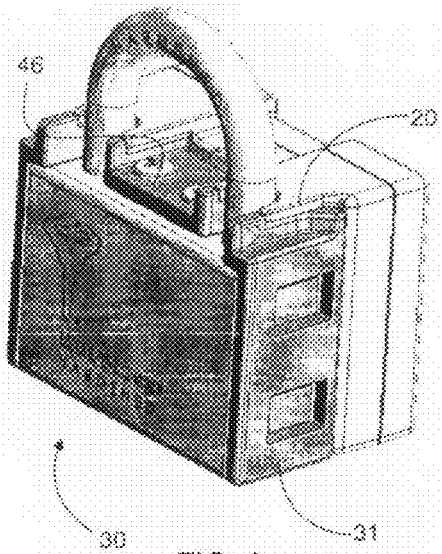
FIGS. 3*a* and 3*b* are pictorial views of a modified padlock for interacting with a status detector and communication unit according to an embodiment of the disclosure.
Figure 3B:
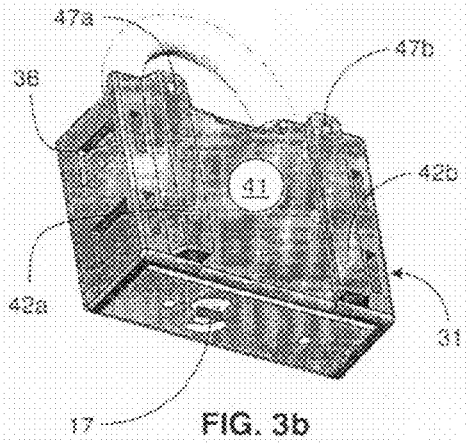
Figure 4B:
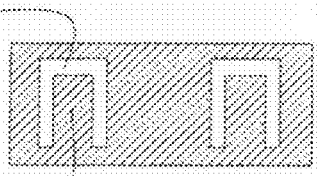
FIGS. 4*b* and 4*c* depict respective detailed side views of the padlock and the interface unit showing their mutual interlocking.
Figure 4A:
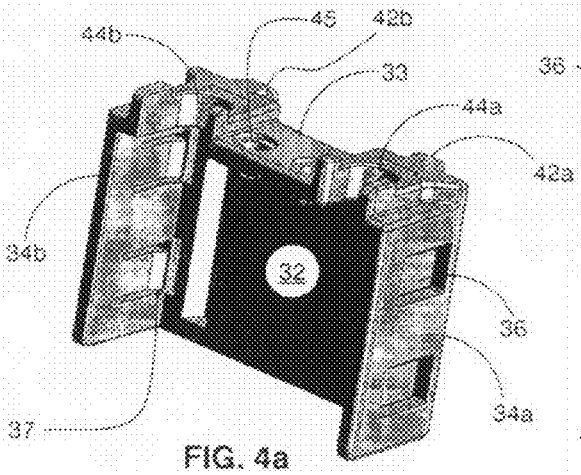
FIG. 4*a* is a pictorial view of an interface unit for coupling the status detector and communication unit to the padlock in FIGS. 3*a* and 3*b;*
Figure 4C:
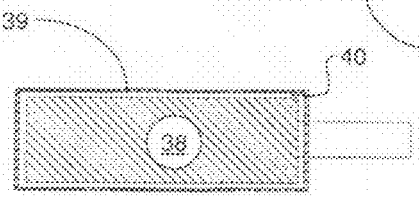

FIGS. 3*a* and 3*b* are pictorial views of a padlock 30 that is adapted for attachment to the status detector and communication unit 20 via an interface unit 31 (mark 31 also to 3*b*) shown retrofitted to the padlock in FIGS. 3*a* and 3*b* and shown separately in FIG. 4*a*. Mechanical features of the status detector and communication unit 20 are described below with reference to FIGS. 5*a* to 5*d*, while electrical functionality of the status detector and communication unit 20 is described with reference to FIG. 7. In an embodiment of the disclosure reduced to practice, the padlock 30 is a commercially available unit from Mul-T-Lock Technologies Ltd. of Yavne, Israel and sold under catalog number 29400205-A. The interface unit 31 may be formed of injection molded plastics having a generally open box construction comprising an inner surface 32 dimensioned for abutting a major surface of the padlock and supporting a top surface 33 and opposing side surfaces 34*a*, 34*b*. As shown in FIG. 4*b*, U-shaped windows 35 are cut in the side surfaces 34 so as to form stiffly resilient leaves 36, an inner lip of each of which is beveled to form a respective notch 37. As shown schematically in FIG. 4*c*, the padlock includes a mechanism 38 having opposed beveled edges fixed within an outer shell 39, such that there are formed opposing ridges 40 between the inner surface of the shell and the beveled edges. This allows the interface unit 31 to be push-fitted on to the padlock 30, whereby the resilient leaves 36 are flexed outward by the side surfaces of the shell 39 until the notches 37 become aligned with the ridges 40, whereupon the leaves 36 revert to their relaxed state with the notches 37 firmly latched in the ridges 40. In this state, all four notches 37 must effectively be lifted simultaneously against the stiff resilient bias of the leaves 36, thus making it very difficult to remove the interface unit 31 once it is attached to the padlock.

Figure 5A:
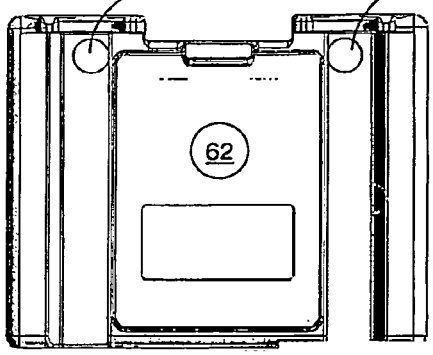
FIGS. 5*a* to 5*d* are pictorial views showing details of the status detector.
Figure 5B:
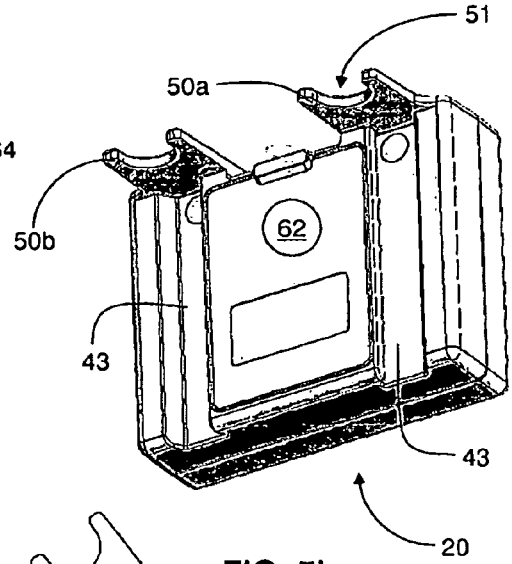
Figure 5C:
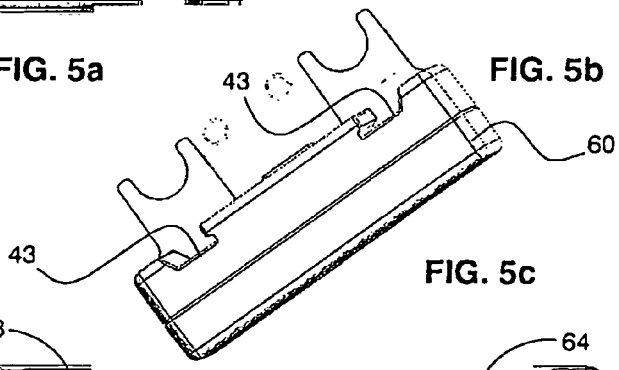

The interface unit 31 is provided on an outer surface 41 thereof opposite the surface 32 with opposing first recesses 42*a* and 42*b* which slidingly engage complementary rails 43 formed in an outer surface of the status detector and communication unit 20, shown in FIG. 5*c*. A pair of opposing semi-circular recesses 44*a*, 44*b* in the upper surface 33 allow for abutting engagement with the shackle. Fixing holes 45 in the upper surface 33 allow the interface unit 31 to be fixed via screws 46 to threaded bores (not shown) formed in an upper surface of the shell 40 of the padlock. The interface unit 31 includes a pair of pins 47*a*, 47*b* that are resiliently mounted in respective bores through the outer surface 41 of the interface unit 31 close to the top surface 33 thereof. The pins 47*a*, 47*b* have rounded ends and are resiliently biased so that, prior to mounting the status detector and communication unit 20 on to the interface unit 31, the ends of the pins slightly protrude from the inner surface of the interface unit 31 while their opposite ends are concealed within their respective bores.

Figure 4D:
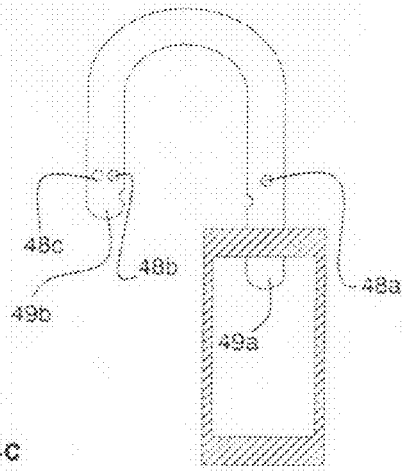
FIG. 4*d* shows a detail of a modification to the shackle of the padlock for cooperating with actuators in the interface unit.

FIG. 4*d* shows a detail of a modification to the shackle 12 of the padlock for co-operating with the pins 47*a*, 47*b* in the interface unit 31. Thus, sockets 48*a*, 48*b* and 48*c* are formed in the shackle 12 in proper spaced relationship so that when the padlock 30 is locked, the socket 48*a* formed in the fixed end 49*a* of the shackle is exactly aligned with the pin 47*a*, whereby the end of the pin 47*a* is accommodated within the socket 48*a*. Thus, when the padlock is armed, the pin 47*a* does not protrude outward from the interface unit 31. On the other hand, the sockets 48*b* and 48*c* are formed in the opposite end 49*b* of the shackle (i.e. the end that disengages from the locking mechanism) so as to be slightly out of alignment with the pin 47*b*. Specifically, the sockets 48*b* and 48*c* are formed on opposite sides of an imaginary axis that is aligned with the pin 47*b* when the padlock is armed. Thus, when the padlock is armed, the sockets 48*b* and 48*c* are both slightly offset relative to the pin 47*b* on opposite sides thereof. The pin 47*b* is therefore pushed by the shackle so as to protrude outward. However, when the padlock is armed, if the shackle is severed so as to allow independent rotation of the two broken halves of the shackle, even a slight rotation of the end 49*b* in either direction will cause one of the sockets 48*b* and 48*c* to rotate into alignment with the pin 47*b*, which will then be retracted so as no longer to protrude out of the interface unit 31. Likewise, the fixed end 49*a* of the shackle, once broken, is capable of independent rotation, which causes the pin 47*a* to be misaligned with the socket 48*a*. Consequently, any change in status of the padlock or any attempt to tamper with the padlock induces a change in the state of the actuators constituted by the pins 47*a* and 47*b*, which in turn induces operation of the microswitches 63 and 64, thus alerting the status detector and communication unit 20. The sockets 48*a* and 48*b* thus serve as encoders that co-operate with the actuators so as to provide an indication whether the corresponding end of the shackle is in an inserted or retracted state and also whether the end is rotated while still being retained within the body of the padlock.

One particular application of the disclosure relates to real time monitoring and tracking of shipping containers, which are locked by authorized personnel at the port of embarkation with a padlock whose status must be continually monitored. This is typical of security applications, where the padlock must be tamper-proof and the actuators as described above address this requirement. However, there may be applications where security is not a principal consideration and only an instantaneous status is required, in which case only a single actuator may be necessary. For example, it is not uncommon for people to leave their premises and then worry that they have forgotten to lock the house or garage. If, for example, the garage were locked with a suitably modified padlock, a single actuator would be sufficient to indicate whether or not the padlock were locked. It will be noted that a padlock can be locked even when it is not affixed to the doors that it is intended to safeguard. Consequently, knowing only the instantaneous status may not be sufficient unless the padlock is armed by an authorized officer, thus establishing a verified initial state, who then reports in a secure manner to the remote monitoring unit. But in the case of a homeowner who is both the "authorized officer" and the "remote monitoring unit" this is not a consideration and so a single actuator may be sufficient to provide the required feedback.

The purpose of the screws 46 is not so much to prevent removal of the interface unit 31, which as noted above is rendered difficult on account of the latches formed by the notches 37. Rather the screws reduce the possibility of any slight play between the padlock and the interface unit and thereby ensure that the interface unit is accurately aligned with the padlock and that the pins 47*a*, 47*b* are correctly oriented with respect to the sockets 48*a*, 48*b* and 48*c*.

Referring to FIGS. 5*a* to 5*c* further mechanical details of the status detector and communication unit 20 will now be described. Thus, mention has already been made of the rails 43 that slidably engage the tracks 42*a* and 42*b* of the interface unit 31. The tracks 42*a*, 42*b* and the rails 43 are undercut so that the status detector and communication unit 20 dovetails with the interface unit 31. Protruding outward from the upper surface 33 of the status detector and communication unit 20 toward opposite edges are two opposing fingers 50*a*, 50*b* each having a semi-circular recess 51 at its end for abutting against the shackle. Once the status detector and communication unit 20 is retrofitted to the padlock, the semi-circular recesses 51 are aligned with the respective semi-circular recesses 44*a*, 44*b* of the interface unit 31 and straddle respective legs of the shackle. It should be noted that the protruding fingers 50*a*, 50*b* prevent the status detector and communication unit 20 from being dovetailed with the interface unit 31 unless the padlock is open, so that the end 49*b* is lifted from its socket, thus allowing the end 49*a* to be lifted and rotated through 90° so as to present only a single leg to the finger 50*a*. In this position, the pin 47*a* is pushed by the end 49*a* (FIG. 4*d*) so as to protrude outward of the interface unit 31 and the status detector and communication unit 20 can be mounted from above into sliding engagement between the rails 43 and the tracks 42*a* and 42*b* of the interface unit 31 and pushed all the way down until the fingers 50*a*, 50*b* engage corresponding recesses formed in the upper surface of the interface unit. Once this is done and the padlock is closed, the socket 48*a* formed in the fixed end 49*a* of the shackle is exactly aligned with the pin 47*a* so that the pin 47*a* retracts into the socket 48*a* and no longer protrudes. On the opposite leg of the shackle the reverse occurs. Thus, prior to arming the padlock, the end 49*b* of the shackle is clear of the pin 47*b*, which is therefore retracted. As soon as the end 49*b* is rotated into the recess 44*b*, it pushes the pin 47*b* so that it protrudes outwardly. When the padlock is locked by pushing down on the shackle, the end of shackle intermediate the sockets 48*b* and 48*c* maintains pressure on the pin 47*b*, which continues to protrude.

The status detector and communication unit 20 has a casing 60 (FIG. 5*c*) in an inside surface of which is a battery compartment 61 (FIG. 5*d*) that is sealed by a cover 62 (FIG. 5*a*) that may be removed to replace the battery. Once the status detector and communication unit 20 is coupled to the interface unit 31, the battery compartment 61 abuts the outer surface 41 of the interface unit, thus being inaccessible and tamper-proof. Microswitches 63 and 64 (FIGS. 5*a*, 5*d*) are mounted on opposite sides of the status detector and communication unit 20 in proper spaced relationship to the pins 47*a* and 47*b*, which serve as actuators for operating the microswitches and providing status information and identifying a close or open event in real time as explained above.

Figure 5D:
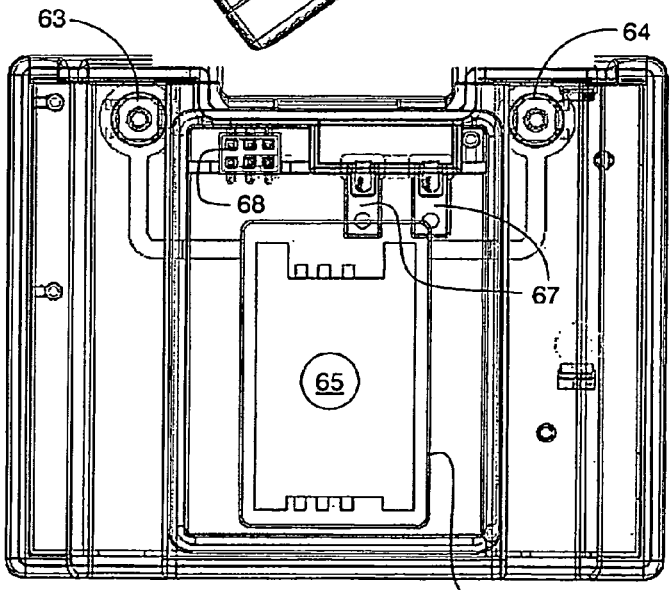

Also accessible from the battery compartment 61 is a SIM card 65 shown in FIG. 5*d* that is located behind the battery and allows GSM communication as explained in greater detail below with reference to FIG. 8. Battery contacts 67 provide contact to the battery and a programming interface outlet 68 is provided for external programming.

This embodiment has been described in significant detail since it discloses a currently preferred embodiment whereby the status detector and communication unit 20 may be retrofitted to a fairly standard padlock while requiring minimal customization of the padlock. To this end, the actuators constituted by the pins 47*a* and 47*b* are provided in the interface unit 31, requiring only that complementary sockets be formed in the shackle of the padlock. While this is most conveniently done during manufacture of the padlock and prior to assembly, it can conceivably be done to an off-the-shelf padlock thus allowing a standard padlock to be adapted for use with the disclosure. However, the required retrofitting can be achieved in other ways, examples of which will now be described.

Figure 6A:
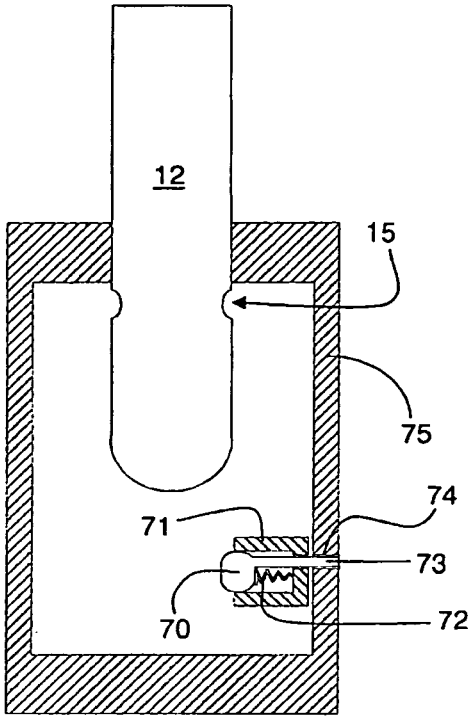
FIGS. 6*a* to 6*d* are schematic representations showing an actuator in a modified padlock according to an embodiment of the disclosure for triggering an attached status detector and communication unit.
Figure 6B:
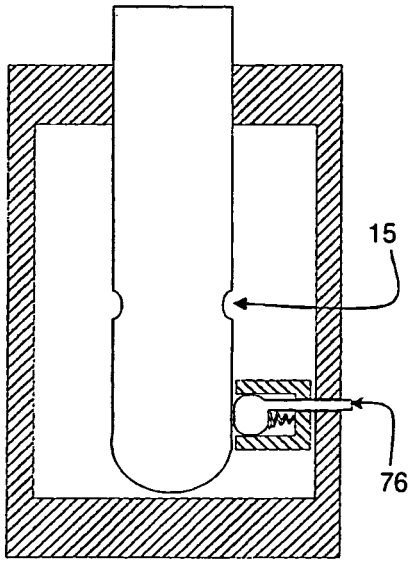

FIGS. 6*a* and 6*b* show a detail of the shackle 12 according to an alternative embodiment having an indent 15 that extends through a side surface of the shackle and is retained by a resilient tongue (not shown) in the locked state. The figures are schematic and the locking mechanism is not itself a feature of the invention and is therefore not shown. Furthermore, for clarity of illustration, the figures are not to scale, it being noted that in an actual padlock the free end of the shackle extends into the body of the padlock by only a short length and not as shown in the figures. Mounted in spaced relationship with the shackle is a resilient abutment 70 retained within an annular support 71 fixed to an inner wall of the padlock body. In the locked state shown in FIG. 6*b*, the shackle 12 engages the abutment, forcing it against a compression spring 72 inside the annular support 71 and therefore causing a pin 73 supported by the abutment to protrude through a bore 74 in the wall 75 of the padlock body. The pin 73 is dimensioned so that in the unlocked state shown in FIG. 6*a* where the spring 72 is extended, an end 76 of the pin 73 is concealed inside the bore 74. Thus, the position of the pin 73 indicates whether the shackle 12 is locked or unlocked.

Figure 7A:
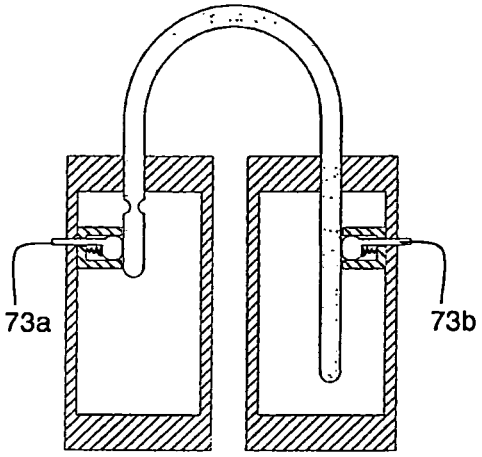
FIGS. 7*a* to 7*c* are schematic representations showing an actuator in a modified padlock according to another embodiment of the disclosure for triggering an attached status detector.
Figure 7B:
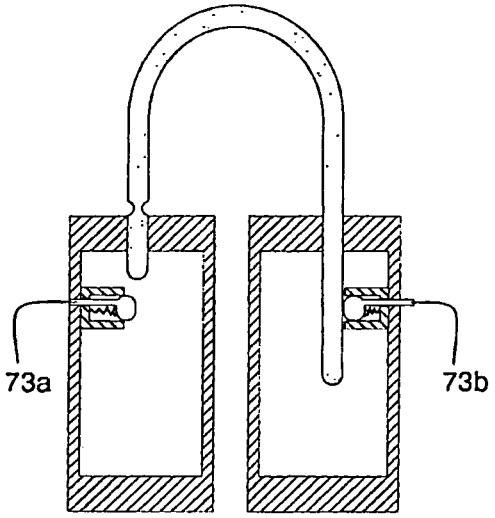
Figure 7C:
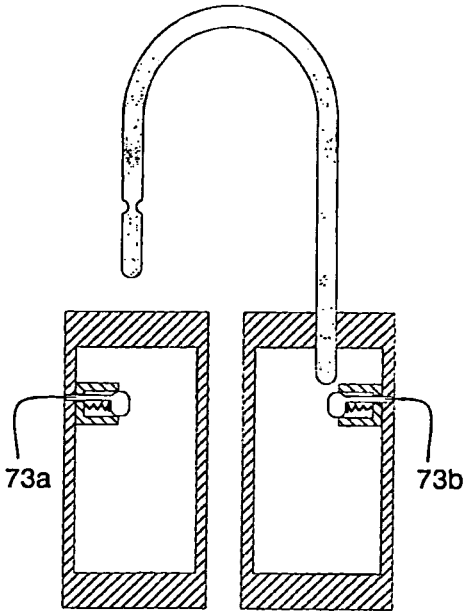

FIGS. 7*a* to 7*c* show schematically an actuator in a modified padlock according to another embodiment of the disclosure where the pins 73*a* and 73*b* are located at the same height of the padlock. In the figures, for ease of illustration, the padlock is shown as two split casings. However, in reality there is, of course, only a single casing and both pins protrude through the same surface of the casing at the same height so as to be aligned with respective contacts of the status detector. Operation of the pins 73*a* and 73*b* is the same as described above and is self-evident from the figures in the light of the foregoing description.

Figure 6C:
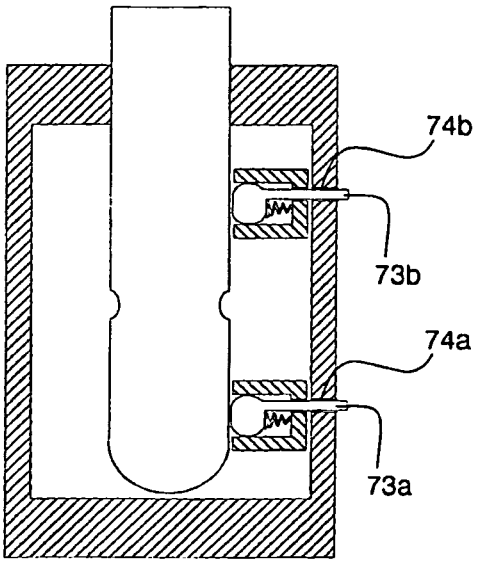
Figure 6D:
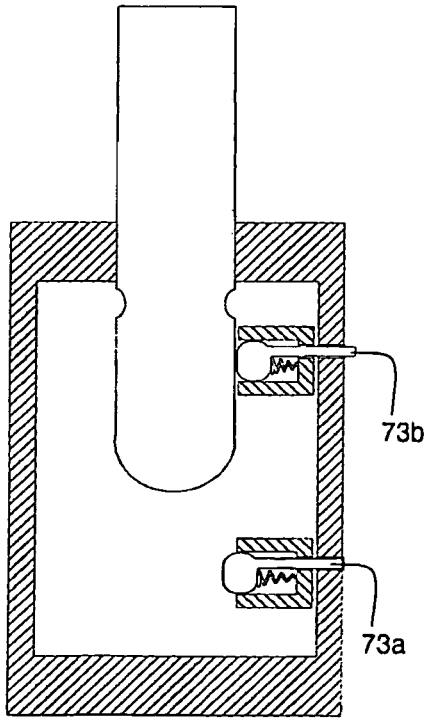

As explained above, security applications require the actuators to be tamper-proof. Enhanced security is provided by providing two spaced apart pins 73*a* and 73*b* as shown in FIGS. 6*c* and 6*d* accommodated within respective bores 74*a* and 74*b*. Thus, in the locked state shown in FIG. 5*c*, both the lower pin 73*a* and the upper pin 73*b* protrude through the respective bores 74*a* and 74*b*. When the shackle is partially released and withdrawn upwards from the padlock, the lower pin 73*a* is concealed under the action of the lower compression spring. When the shackle is completely removed from the body of the padlock, the upper pin 73*b* is likewise concealed under the action of the upper compression spring. So a change in state from (i) lower and upper pins protrude, to (ii) lower pin concealed and upper pin protrudes, to (iii) lower and upper pins concealed is indicative of an initially locked padlock being unlocked. The reverse holds true when an initially unlocked padlock is locked and is indicated by a change in state from (i) lower and upper pins concealed, to (ii) lower pin concealed and upper pin protrudes, to (iii) lower and upper pins protrude. Thus, the order in which the pins become concealed or protrude provides an indication not merely of instantaneous status but also of whether the padlock is in an initially unlocked status and is being locked, or whether the padlock is in an initially locked status and is being unlocked. In other words, a single pin provides only static information regarding the padlock's status, while two pins also provide temporal information indicative of an action currently being carried out in real time.

The embodiments shown in FIGS. 6 and 7 differ from that shown in FIGS. 4 and 5 in that the actuators in the embodiment of FIGS. 6 and 7 are part of the padlock while in the embodiment of FIGS. 4 and 5, they are part of the interface unit. Nevertheless, in all cases, the pins provide an immediate indication of the status of the shackle and can be used to actuate appropriate microswitches in the status detector and communication unit.

Figure 8:
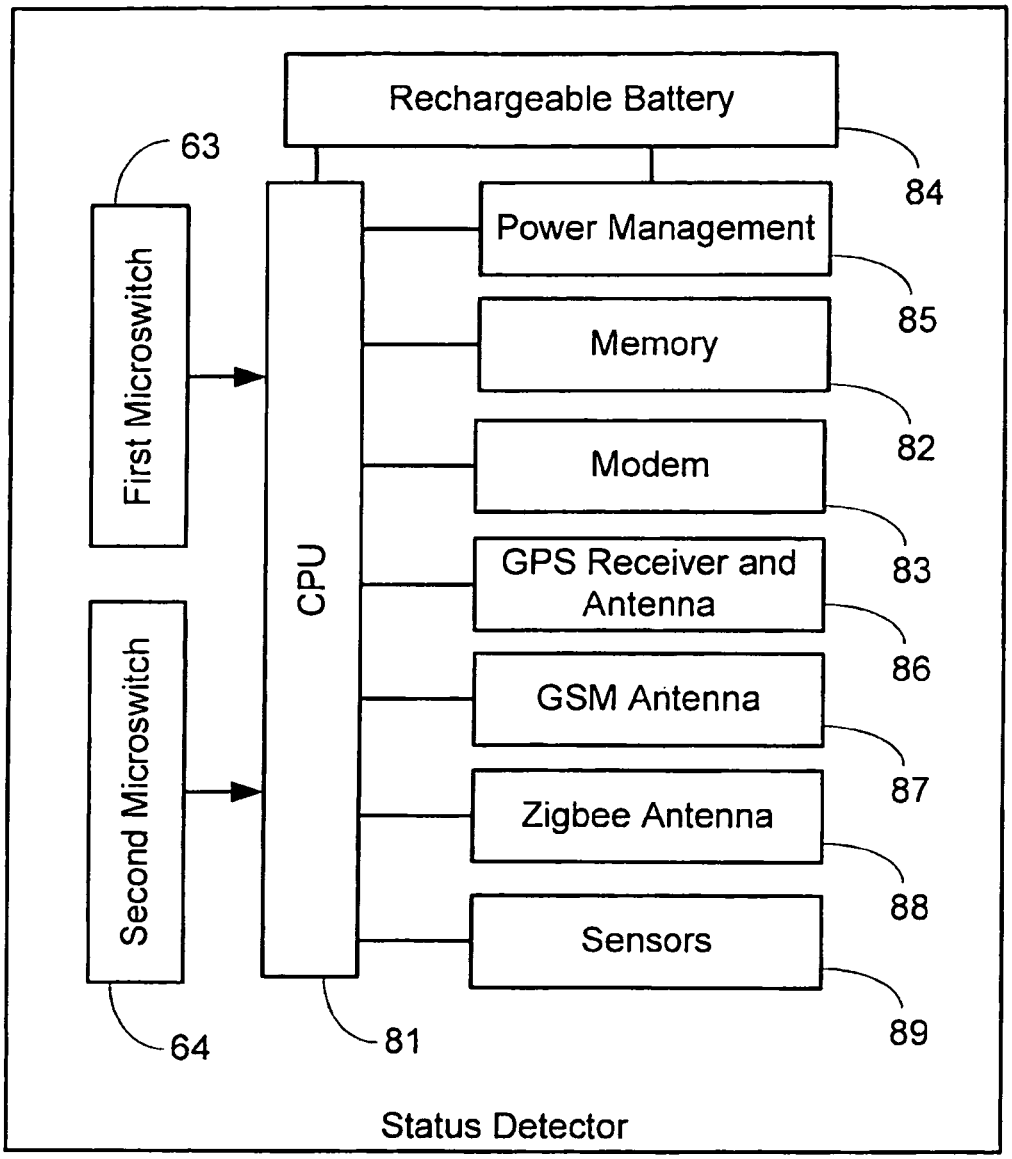
FIG. 8 is a block diagram showing the functionality of the status detector.

FIG. 8 is a block diagram showing the functionality of the status detector and communication unit 20 specially adapted for monitoring a padlock of a shipping container. The status detector and communication unit 20 includes a CPU 81 (constituting a processing unit) which includes a memory 82 and to which there are coupled a cellular receiver/transmitter modem 83 suitable for operation in a GSM, HS GSM or CDMA networks. Active components in the status detector and communication unit 20 are powered by a rechargeable battery 84, which is constantly monitored by a power management controller 85 and which is responsive to detector signals produced by the microswitches 63*a* and 63*b* and/or external interrogation signals or interrupts for awakening the CPU 81 for the required response. Remote bi-directional communication is facilitated by a GPS receiver and antenna 86, a cellular or satellite antenna 87 (constituting a long-range antenna) and a ZigBee antenna 88 (constituting a short-range antenna). The GPS receiver and antenna 86 and the ZigBee antenna 88 are off-the-shelf modules that are fixedly mounted inside the casing 21 of the status detector 20 and connected to the processor 81 by a flexible PCB (not shown). The cellular or satellite antenna 87 facilitates long-range communication and is coupled by wires to a communication processor (not shown) that is housed within the casing 21. The ZigBee antenna 88 facilitates short-range communication and can receive data from independent sensors 89 installed in the container. The sensors are not a feature of the present disclosure and so are not described in further detail. A full description of the sensors is provided in co-pending PCT/IL2010/000859 filed Oct. 20, 2011, in the name of the present Applicant and entitled "Location and Tracking Device and System for a Shipping Container." It will be appreciated that other forms of communication may also be provided such as long-range GSM, HS GSM, CDMA, or Satellite, mid-range WiMAX or WiFi and short-range RF, RFID, BlueTooth™ allowing communication between multiple status detectors 20 affixed to different containers or between status detectors and external sensors or other devices. Communication between status detectors affixed to different containers allows a container to be externally monitored even if its long range communication is faulty. In such case, the faulty device can relay the information over the short range network to another device that will forward the information over the long range infrastructure to a remote tracking server. This allows data of all modules within short broadcast range to be backed up.

The GPS receiver and antenna serve as a location module for providing a realtime signal indicating the padlock's location in space. Other Satellite-based protocols may also be used, such as Galileo, Glonass and Ground Cellular Cells all of which are known in the art.

Figure 9:
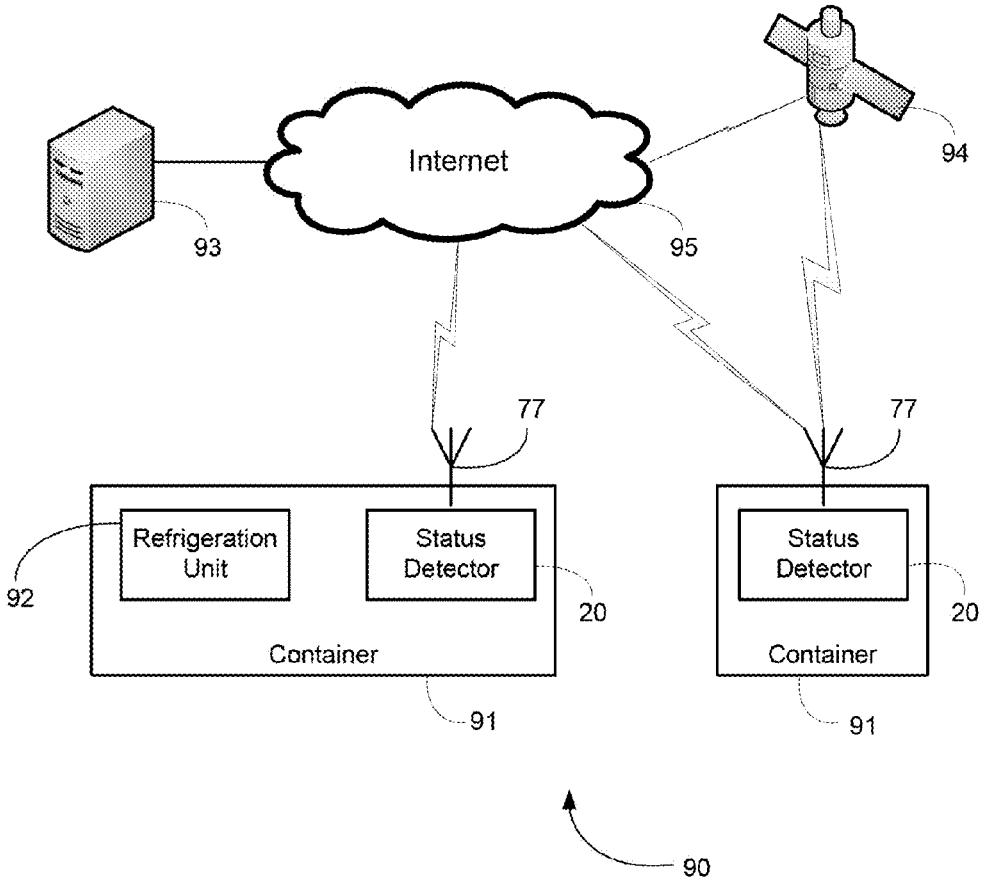
FIG. 9 is a schematic representation of a system for tracking shipping whose doors are protected using padlock-detector modules according to the disclosure.

FIG. 9 is a schematic representation showing a system 90 for tracking freight vehicles such as containers 91 at least one of whose doors is secured by a padlock retrofitted to a status detector and communication unit 20 as described above. For the sake of complete explanation, at least one of the containers 91 is used to transport cold food and includes a refrigeration unit 92. The system 90 includes a server 93 that is operated by a tracking center (not shown) for monitoring containers in real time. Failure of the refrigeration unit 92 is another example of a security event that must be reported to the server. The refrigeration unit 92 can be remotely operated by the server as well as being monitored and activated by the on-board CPU 15. The status detectors and communication unit 20 include antennas 77, it being recalled that multiple antennas may be provided, each operating over a predetermined range and protocol. The GPS antenna 86 (shown in FIG. 8) communicates with two or more satellites 94, which convey spatial location to the server 93 via the Internet 95.

Logic

The following logic states apply to the status detector and communication unit 20:

Passive State—The device 20 is powered. Any sensors associated therewith are in an inactive state.

Armed State—All sensors are connected directly to the power management controller 85. When the status detector and communication unit 20 is armed, the power management controller is the only subsystem that is active. The entire system becomes alive upon any one or more of the sensors providing an indication or alert signal to the power management controller.

Silent Alarm—In this state the power management controller 85 awakens the CPU 81 to recheck on an intercepted signal. If an intercepted signal repeats more than a specified number of times that may be preset by the customer, the power management controller 85 awakens the location and radio modules. Otherwise, all the sensors as well as the power management controller go into a sleep mode.

Emergency—The system is up and verifies an intercepted signal several times before activating the status detector and communication unit 20, which then sends the location and information on the sensor type waiting for message acknowledgment from the network before shutting down the entire system then switching to an armed state. In a system that monitors only the padlock status and has no other sensors, the sensor type is indicative of one of the two microswitches 63 and 64.

The power management controller 85 is configured so as to cause minimum intervention commensurate with providing real time monitoring and tracking, so that the CPU 81 remains dormant and power consumption is reduced to a minimum. However, in order to provide real time monitoring and tracking, it is nevertheless necessary that the power management controller 85 awaken the CPU 81 periodically and convey the current status to the server 93. Likewise, the server 93 can itself interrogate the status detector and communication unit 20 but this also drains the battery in the device. Consequently, a reasonable balance has to be drawn between obtaining updated location and status of the container and preserving battery power.

In one embodiment of the invention, the time period between interrogations, whether they be remotely initiated by the server 83 or locally by the power management controller 85 may be pre-set and stored either in the memory 82 of the status detector 20 or in the server 93. Whenever the power management controller 85 awakens the CPU 81 it associates with the current status a timestamp that is stored with the status in the memory 82. Only when the lapsed time from the most recent timestamp exceeds the preset time interval between interrogations, does the power management controller 85 awaken the CPU 81 for determining a subsequent status of the container. Data conveyed to the server 93 likewise includes a respective timestamp, thus allowing the server to operate in like manner. Obviously, a security event will override this logic.

The time interval between interrogations may be automatically computed as a function of estimated voyage time, so that for long voyages lasting weeks or months, the time interval between interrogations is reduced (in absolute terms) so as to conserve battery, while for short voyages more frequent interrogations can be permitted.

User Interface—Application/Software

The server 93 incorporates a user interface that is accessible via a workstation or computer terminal coupled to the server 93 either directly or remotely and enables an operator to display a specified container on a map in real-time, and send messages and commands to a specified status detector and communication unit 20. For example, the remote operator can cause the status detector and communication unit 20 to change transmission intervals or to turn on the refrigeration system 92, if appropriate. The user interface also allows the operator to generate a variety of informative reports, and to predefine relevant alert messages to be sent to a list of cellular phone recipients. The user interface may be customized geographically to support different languages and different street-level maps depending on geographic location.

The user interface system provides two interfaces:

Online software application: —This resides on the server 93 for access by an end user and enables the end user to customize and define various alerts for each event and determine if an alert is to be sent to a mail recipient or one or more cellular subscribers etc. For instance, an event may be initiated only if a container arrives at its destination and the door is opened. Likewise, an event may be initiated if during the transportation of a container its ambient temperature increases and it is more than a specified distance from destination.

Procedures software application: —This is aimed at emergency events that require immediate response, for instance theft or temperature increase and allows the end user to define in advance the right procedure to be taken upon occurrence of such an event. For instance, if an unauthorized door open event occurs, a police car may be rushed to site to handle the situation. Or if temperature exceeds a preset threshold, a technician may be immediately called to site to handle and fix the problem.

It is to be noted that event-driven interfaces and event-handling in general are well-known in the art and these features are therefore not described in detail. However, the disclosure permits event-handling to be implemented in real-time only by virtue of the fact that, unlike hitherto-proposed systems, the containers are tracked in real-time and the instantaneous location of each container is thus known in real-time. This permits not only tracking and monitoring of containers, but also allows event-driven remedial action to be carried out by entities that are external to the container and that are automatically dispatched to the container based on location data provided by the server 83.

Figure 10:
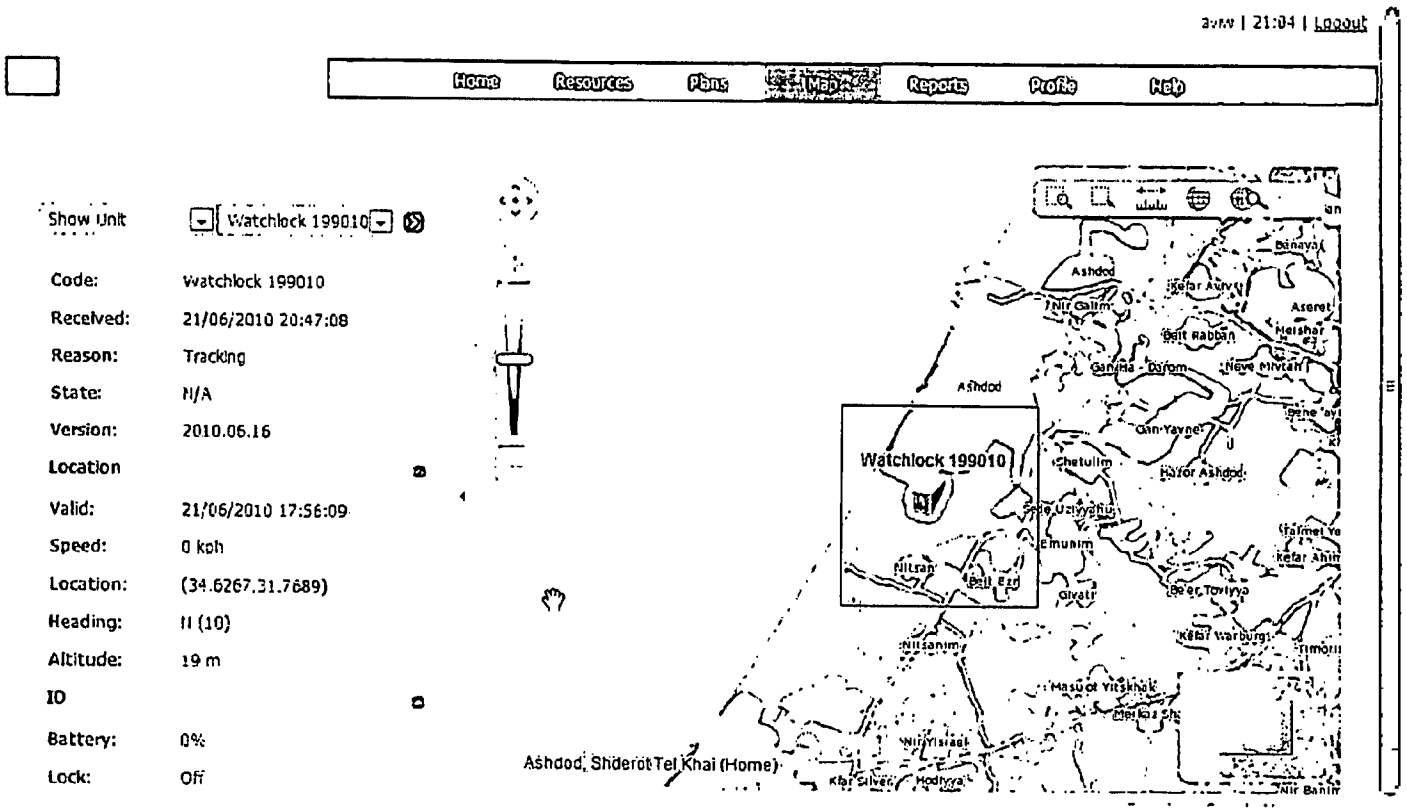
FIG. 10 is a map depicting real-time tracking of padlocks by a remote monitoring center.

For example, FIG. 10 shows a map that permits an operative to see at a glance the location of each tracked container in real-time and to determine whether the container is on schedule. The operator can manually initiate communication with the module in the container so as to check, for example, the temperature, the status of various sensors, $CO_2$ levels and so on. However, the sensors themselves generate signals that are processed either by the external server 93 or by the CPU 81 within the module itself, for establishing events and, upon occurrence of events thus established, for taking action in accordance with procedures preset by the end user.

It will be appreciated that modifications may be made to the embodiments as described without departing from the scope of the attached claims. For example, while the status detector is adapted to be retrofitted to a padlock by an end-user, it will be appreciated that this may also be done in the factory so that the padlock and detector are sold as an integral unit. In either case, mounting the status detector external to the padlock avoids the need to provide electronics within the padlock.

While the padlock is described as operating using a key, it will be understood that the principle of the disclosure are also applicable to combination padlocks. Similarly, while the padlock as described has a shackle one of whose ends is permanently fixed in the body of the padlock, the disclosure is also suitable for use with padlocks having larger flexible shackles both of whose ends are removable from the body and are independently secured thereto.

Likewise, while an application has been described with particular reference to shipping containers, it will be understood that the invention is also applicable to the monitoring of other sea or land based freight vehicles.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet which are commonly owned with this application are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A status detector and communication unit for a padlock having a body and a shackle at least one end of which can be latched to and released from the body, the status detector and communication unit, status detector and communication unit comprising:

a casing adapted to be securely retrofitted to the padlock so as to form a compact assembly without obscuring an operating mechanism of the padlock, a battery powered circuit contained within the casing for co-operating with the shackle of the padlock for transmitting a signal indicative of a status of the shackle to a remote monitoring unit, at least one switch contact within the casing and connected to the circuit for conducting electrical signals indicative of the status of the shackle, the at least one switch contact being mounted in spatial association with a corresponding end of the shackle for mechanical actuation upon movement of the shackle so as to provide feedback regarding whether said end is in an inserted or a retracted state, and a pair of actuators each adapted to cooperate with a respective encoder located at a respective end of the shackle and to provide an indication whether the corresponding end of the shackle is in an inserted or retracted state.

2. The status detector and communication unit according to claim 1, wherein the actuators are further adapted to indicate whether the end of the shackle is rotated while still being retained within the body of the padlock.

3. The status detector and communication unit according to claim 1, comprising:

one or more sensors within the casing and coupled to a processing unit for detecting a change in status of the padlock, a GPS unit integrally mounted in the casing and coupled to the processing unit for providing a position signal, a cellular or satellite modem integrally mounted in the casing and coupled to the processing unit for providing data communication carrier via long range networks, a battery compartment within the casing for accommodating a battery for providing power to the status detector and communication unit and to the sensors and the cellular or satellite modem therein, a power management controller for monitoring battery power level and being responsive to sensor signals and external interrogation signals or interrupts for awakening the processing unit, and at least one long-range antenna for effecting continuous real time tracking and communication with a remote tracking server for informing the tracking server of an instantaneous location in space of the padlock and any security events.

4. The status detector and communication unit according to claim 1, further including a short-range antenna for allowing short-range communication with another status detector in short-range proximity.

5. The status detector and communication unit according to claim 3, wherein the processing unit is responsive to impaired long-range communication for conveying data to a nearby status detector in short-range proximity via the short-range antenna for relaying to the remote monitoring unit.

6. The status detector and communication unit according to claim 1, wherein the circuit includes a light emitter and associated light detector for receiving at least some of the light emitted from the emitter, the light emitter and detector being disposed in spatial relationship within the casing so that when retrofitted to the padlock the amount of light received by the detector when the shackle is in the closed position is different than when the shackle is in the open position.

7. The status detector and communication unit according to claim 1, wherein the casing of the status detector and communication unit is provided at an upper end with a bracket having an aperture through which the shackle is inserted.

8. The status detector and communication unit according to claim 6, including a resilient L-shaped bracket on a lower end of the casing and being adapted for snap-fitting to a base of the padlock.

9. The status detector and communication unit according to claim 1, for use with a custom padlock that is modified for attachment to the status detector and communication unit via an interface unit.

10. The status detector and communication unit according to claim 8, wherein the interface unit is of generally open box construction comprising a major inner surface dimensioned for abutting a major surface of the padlock and supporting an upper surface and opposing side surfaces.

11. The status detector and communication unit according to claim 9, comprising rails formed in an outer surface of the status detector and communication unit for sliding engagement with complementary rails formed in a major external surface of the interface unit.

12. The status detector and communication unit according to claim 9 wherein the interface unit includes fixing holes in the upper surface for screwing the interface unit to threaded bores in the upper edge of the padlock body.

13. The status detector and communication unit according to claim 8, wherein the padlock has a mechanism that is configured so that movement of the shackle induces movement of at least one actuator that serves to actuate a microswitch in the status detector and communication unit.

14. The status detector and communication unit according to claim 12, wherein the actuators are provided in the interface unit.

15. The status detector and communication unit according to claim 13, wherein:

the actuators are resilient pins that are incorporated through a surface of the interface unit abutting the padlock and are adapted for actuation by an outer surface of the shackle, which pushes the pin through the interface unit so as to actuate a corresponding one of the microswitches, and at least one socket is formed in an end of the shackle for retaining said pin therein when aligned therewith so as to prevent the pin from protruding through the interface unit and actuating the microswitch.

16. The status detector and communication unit according to claim 14, wherein one end of the shackle includes two sockets formed on opposite sides of an axis that is aligned with the pin when the padlock is armed so that the sockets are both slightly offset relative to the pin on opposite sides thereof but are brought into alignment with the pin if the shackle is severed and said end is rotated.

17. The status detector and communication unit according to claim 8, including respective notches formed on internal side surfaces of the interface unit and being adapted to engage opposing ridges in a side surface of the padlock thus allowing the interface unit to be push-fitted and secured on to the padlock.

18. A system for tracking moveable freight vehicles each secured using a padlock retrofitted with a status detector and communication unit according to claim 3, said system including:

a server for tracking the freight vehicles in real time, the respective GPS unit in each of the status detector and communication units communicating with two or more satellites for conveying to the server spatial location of the respective status detector and communication unit, and the long-range antenna in each of the status detector and communication units conveying data indicative of security events to the server and being configured to allow the server to communicate with the status detector and communication units.

19. The system according to claim 18, wherein:

a time period between communications initiated by the status detector and communication unit to the server is preset and stored in a memory of the status detector and communication unit; and a power management controller awakens the CPU and associates with a current status a timestamp that is stored with the current status in the memory;

the power management controller is responsive to a measured lapsed time from a most recent timestamp exceeding the preset time interval between communications for awakening the CPU for determining a subsequent status of the freight vehicle.

* * * * *